US007175019B2

(12) United States Patent
Beal et al.

(10) Patent No.: US 7,175,019 B2
(45) Date of Patent: Feb. 13, 2007

(54) JEWELRY STORAGE AND DISPLAY DEVICE

(75) Inventors: Daniel C. Beal, Holland Patent, NY (US); John C. Waszkiewicz, III, New Hartford, NY (US); Lawrence P. Ulrich, Whitesboro, NY (US); Geoffrey J. Thorp, Remsen, NY (US); Michael L. Beal, Ilion, NY (US)

(73) Assignee: Faster-Form Corporation, New Hartford, NY (US)

( * ) Notice: Subject to any disclaimer, the term of this patent is extended or adjusted under 35 U.S.C. 154(b) by 187 days.

(21) Appl. No.: 10/836,836

(22) Filed: Apr. 30, 2004

(65) Prior Publication Data

US 2005/0241960 A1 Nov. 3, 2005

(51) Int. Cl.
*A45C 11/04* (2006.01)
*G09F 1/00* (2006.01)

(52) U.S. Cl. ..... 206/6.1; 40/124.06

(58) Field of Classification Search ..... 206/6.1 X, 206/566, 45.2–45.29, 45.24 X; D9/457; 40/124.06, 124.16–124.18
See application file for complete search history.

(56) References Cited

U.S. PATENT DOCUMENTS 1,359,617 A 11/1920 Nielsen
1,713,584 A 5/1929 Wolf
3,769,741 A * 11/1973 Hessler et al. ..... 43/57.1
4,149,630 A * 4/1979 Transport ..... 206/45.24
4,181,224 A 1/1980 Aber
4,371,077 A 2/1983 Solitt et al.
4,459,772 A * 7/1984 Kanzelberger ..... 40/745
4,687,103 A 8/1987 Corbett
4,787,516 A * 11/1988 Morrison ..... 206/566
4,848,586 A 7/1989 Jasik
4,923,069 A * 5/1990 Germain et al. ..... 211/85.2
5,141,300 A 8/1992 Ciesla
5,160,049 A * 11/1992 McMillen, Jr. ..... 211/85.2
5,439,101 A * 8/1995 Brink et al. ..... 206/45.24
5,950,815 A * 9/1999 Yetman-Bellows ..... 206/6.1
6,205,688 B1 3/2001 Grosser-Samuels

* cited by examiner

*Primary Examiner*—Jila M. Mohandesi
(74) *Attorney, Agent, or Firm*—Peter J. Bilinski

(57) ABSTRACT

A device for storing and displaying jewelry having a frame fabricated from a single sheet of resilient material. The frame contains parallel, spaced apart front and rear panels that are co-joined along their upper edges by a top wall. The front panel extends below the rear panel and a base is integrally connected to the lower edge of the front panel and extends rearwardly beneath the rear panel. The front panel includes a window through which access can be gained to a foam pad that is captured between the front and rear panels. Studded hooks are inserted into the pad upon which various items of jewelry can be hung. Pins and studded pieces of jewelry can also be inserted directly into the pad for display and storage purposes.

13 Claims, 2 Drawing Sheets

JEWELRY STORAGE AND DISPLAY DEVICE

FIELD OF THE INVENTION

This invention relates to a device for storing and displaying various pieces of jewelry.

BACKGROUND OF THE INVENTION

Typically, most pieces of jewelry are stored in jewelry boxes which are capable of being locked to protect the contents from being tampered with or misplaced. Most jewelry boxes are compartmentized to segregate different types of pieces, however, the compartments tend to become crowded making it difficult to isolate and compare pieces that might go best with an outfit for a specific occasion. Chain type bracelets and necklaces tend to become entangled and a good bit of time can be consumed in untangling the pieces making the wearer late for appointments or meetings. Similarly, smaller pieces such as pins and matching earrings are also sometimes difficult to find thus further consuming valuable time when the wearer can least afford it.

Even after a number of pieces have been located and removed from the jewelry box, the wearer might be unhappy with the selection and the process of isolating and removing other pieces from the jewelry box must be repeated.

Many people, in addition have favorite pieces of jewelry which are worn frequently if not on a daily basis. These frequently worn pieces are generally not placed in a jewelry box and are simply deposited, when not worn, in any convenient location such as sink tops, the tops of furniture, drawers or the like where they can easily become misplaced and lost.

SUMMARY OF THE INVENTION

It is an object of the present invention to improve devices for displaying and storing jewelry.

It is a further object of the invention is to provide a device for safely and conveniently storing and displaying frequently worn pieces of jewelry.

It is a still further object of the present invention to provide a device for allowing selected pieces of jewelry to be displayed in a group to insure the pieces complement each other prior to wearing.

Another object of the present invention is provide a display device that allows a jewelry ensemble to be pre-assembled prior to the jewelry being worn.

Yet another object of the present invention is to provide a display and storage device for frequently worn jewelry thus preventing the jewelry, from being misplaced and lost.

Still another object of the present invention is provide a jewelry display and storage device that can be conveniently seated on a dressing table or on top of a bureau.

These and other objects of the present invention are attained by a device for displaying and storing pieces of jewelry that includes a frame fabricated of a single sheet of resilient material having parallel spaced apart front and rear panels that are co-joined along their upper edges by a top wall. The front panel extends below the rear panel and a base is joined to the lower edge of the front panel that extends rearwardly beneath the rear panel. The front panel contains a window through which access is gained to a foam pad that is captured between the front and rear panels. Studded hooks are inserted into the pad upon which rings, bracelets and necklaces can be hung and studded earrings and pins can be inserted directly into the pad.

BRIEF DESCRIPTION OF THE DRAWINGS

For a better understanding of these and objects of the invention, reference will be made to the following detailed description of the invention which is to be read in connection with the accompanying drawing, wherein.

DETAILED DESCRIPTION OF THE INVENTION

Figure 1:
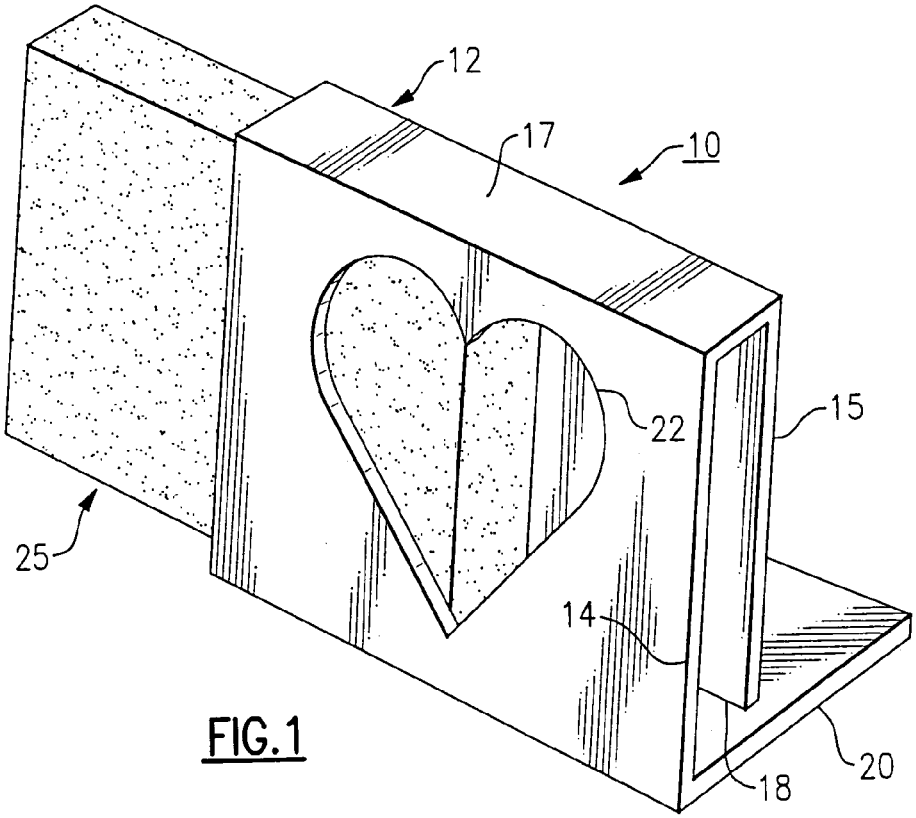
FIG. 1 is a front perspective view illustrating a display device embodying the teachings of the invention.
Figure 2:
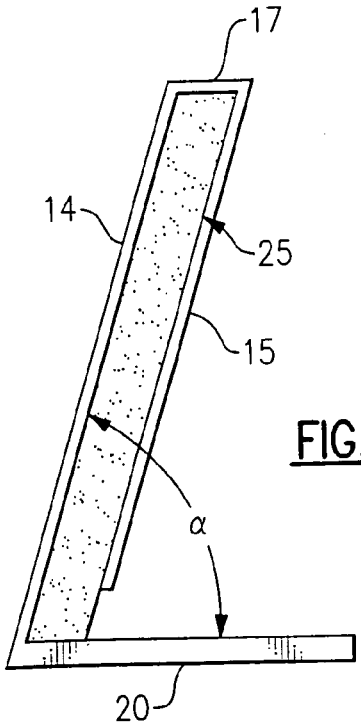
FIG. 2 is a side elevation of the display device shown in FIG. 1.

Referring initially to FIGS. 1 and 2, there is illustrated a device for storing and displaying jewelry items that is generally referenced 10. The device includes a frame 12 that is fabricated from a single sheet such as plastic, stiff paper board and the like. The frame includes a flat front panel 14 and a flat rear panel 15 that are connected along their upper edges by a top wall 17. In this embodiment of the invention the panels are illustrated as being rectangular in shape, however, any suitable shaped panel can be used in the practice of the invention. The two panels are held in spaced apart parallel alignment by the top wall 17. The two panels have about the same width.

The front panel 14 of the device extends downwardly from the top wall to a point below the bottom edge 18 of the rear panel 15. A base 20 is integrally joined to the lower edge of the front panel 14 and extends rearwardly beneath the rear panel of the device 10 to provide a stand by which the device can be seated upon a flat substrate. In this embodiment of the invention, the base 20 is a flat plate that is able to support the front and rear panels 14, 15 in an upright position when placed upon a level surface such as the top of a dressing table, a bureau or the like. As illustrated in FIG. 2, the base 20 preferably forms an acute angle $\alpha$ with the front panel 14, which tilts the two panels slightly to the rear. An angle of between 6 and 10 degrees provides for easy viewing of the front panel 14 when the frame 12 is placed upon a flat substrate.

The front panel 14 of the device 10 is furnished with a clear window 22 that passes through the panel. In this embodiment of the invention, the window 22 is heart shaped, however, it can take any form that might be esthetically pleasing. Preferably, the outline of the window 22 will define some easily recognizable shape. The window 22 should have an area such that a number of jewelry items can be displayed within its boundaries.

A pad 25 is contained within the frame 12 between the front and rear panels 14, 15. The thickness of the pad 25 is slightly greater than the spacing between the front and rear panels 14, 15. The pad 25 is fabricated of a foam material such as polystyrene, polyurethane or the like so that it can be compressed between the panels 14, 15. In assembly, the two panels 14, 15 are pulled apart sufficiently to permit the pad to be passed into the space between the panels and the panels then allowed to return to their normal alignment thus compressing the pad and capturing it between the panels. The pad 25 is cut so that it completely fills the space between the panels 14, 15.

Figure 3:
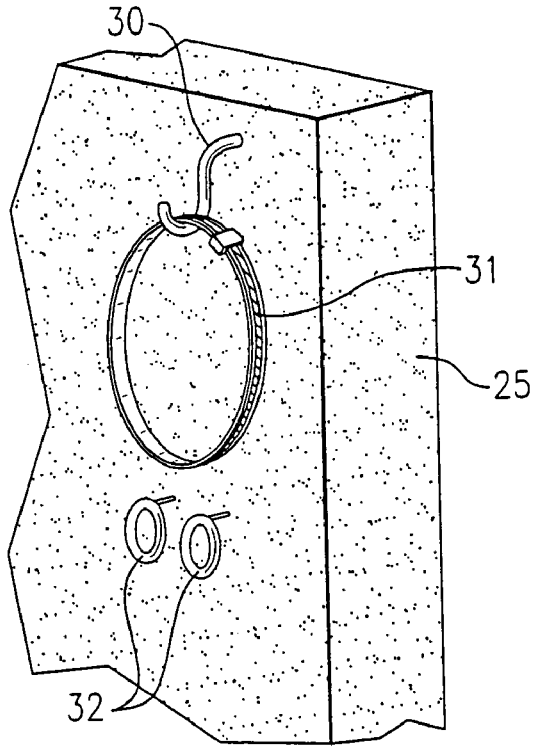
FIG. 3 is an enlarged partial view in perspective showing studs mounted in a foam support pad used in the practice of the present invention.

As illustrated in FIG. 3, studded hooks 30 are provided having pointed shafts that can be easily inserted into the pad 25 to support the hook at a desired location within the window 22. Articles such as rings, bracelets and necklaces can be hung upon the hooks 30 for display and storage purposes. Studded earrings as well as pins and broaches or the like can be similarly mounted in the pad 25 by simply inserting the stud or pin part of the item into the pad. A bracelet 31 and an earring 32 are shown mounted upon pad 25 in FIG. 4 by way of an example.

Figure 4:
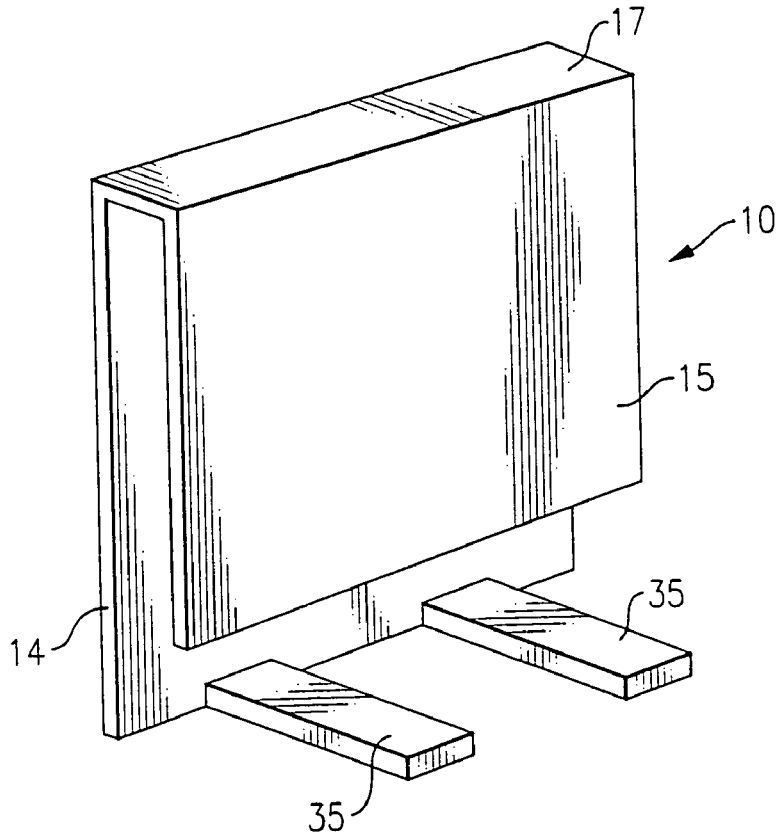
FIG. 4 is a rear perspective view in accordance with a second embodiment.

FIG. 4 is a rear perspective view illustrating a second embodiment of the invention. As noted above, the frame 12 includes a front panel 14 and a rear panel 15 that are co-joined by a top wall 17. In this embodiment, the flat base of the frame is replaced by a pair of elongated flat bars 35—35 that are integrally attached to the bottom edge of the front panel and extend rearwardly under the rear panel of the frame 12 to provide a sturdy support for the frame. Here again the front and rear panels 14, 15 of the frame 12 are angularly offset with regard to the bars to provided for easy viewing of articles mounted in the frame window 22.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A device for displaying and storing jewelry, said device comprising:

a single piece frame fabricated from a single sheet of resilient material;

said frame having a flat front panel and a flat rear panel, said panels being in generally parallel alignment and defined therebetween by a space;

said front and rear panels being integrally co-joined along their top edges by a top wall;

said front panel being longer than said rear panel, said frame further including a base being integrally joined to the bottom edge of the front panel so that the base extends rearwardly beneath the rear panel;

said front panel containing an open window passing there-through; and a resilient pad, said resilient pad solely filling the entire space between the front and rear panels behind said window and in which said resilient pad forms the sole retention medium for jewelry attached thereto, said resilient pad being compressively maintained between said front and rear panels.

2. The device of claim 1, wherein said base is a flat plate.

3. The device of claim 1, wherein said base includes a plurality of flat bars.

4. The device of claim 3, wherein said bars are mounted in parallel alignment.

5. The device of claim 1, wherein said base forms an acute angle with the front panel of the frame.

6. The device of claim 1, wherein the pad is fabricated of a resilient foam.

7. The device of claim 6, wherein said pad has a width that is slightly greater than the space between the front and rear panels to permit the resilient pad to be compressed between the panels.

8. The device of claim 1, wherein the window outlines a recognizable form.

9. The device of claim 1, wherein the frame is fabricated of a resilient plastic.

10. The device of claim 6, that further includes a plurality of studded hooks removably inserted through said window into said resilient pad for supporting rings, bracelets and necklaces.

11. The device of claim 5, wherein the front and rear panels are angled relative to said base by said acute angle.

12. The device of claim 10, wherein said acute angle is between about 6 and about 10 degrees.

13. The device of claim 1, wherein said resilient pad can be inserted through a lateral open side of said frame between said front panel and said rear panel.

* * * * *